US006093063A

United States Patent [19]

Tsuji et al.

[11] Patent Number: 6,093,063

[45] Date of Patent: Jul. 25, 2000

[54] CONNECTOR HAVING A HOLDER FOR MALE SUB-CONNECTORS

[75] Inventors: Masanori Tsuji; Osamu Sugiyama, both of Shizuoka-ken, Japan

[73] Assignee: Yazaki Corporation, Tokyo, Japan

[21] Appl. No.: 09/205,693

[22] Filed: Dec. 4, 1998

[30] Foreign Application Priority Data

Dec. 5, 1997 [JP] Japan ..... 9-335974

[51] Int. Cl.[7] ..... H01R 13/514

[52] U.S. Cl. ..... 439/752; 439/595

[58] Field of Search ..... 439/595, 596, 439/689, 687, 650, 752

[56] References Cited

U.S. PATENT DOCUMENTS

| | | | |
|---|---|---|---|
| 4,636,068 | 1/1987 | Niiho et al. . | |
| 4,979,913 | 12/1990 | Aiello et al. . | |
| 5,120,269 | 6/1992 | Endo et al. | 439/752 |
| 5,216,480 | 6/1993 | Kaneko et al. . | |
| 5,316,504 | 5/1994 | Jinno . | |
| 5,419,722 | 5/1995 | Onoda . | |
| 5,715,101 | 2/1998 | Nakamura et al. . | |
| 5,730,627 | 3/1998 | Okabe | 439/752 |
| 5,803,773 | 9/1998 | Kashiyama et al. | 439/752 |
| 5,860,834 | 1/1999 | Sugiyama | 439/595 |
| 5,931,707 | 8/1999 | Ito | 439/752 |
| 5,984,737 | 11/1999 | Nagano et al. | 439/752 |

FOREIGN PATENT DOCUMENTS

| | | |
|---|---|---|
| 0348900 | 1/1990 | European Pat. Off. . |
| 0 778 636 A1 | 6/1997 | European Pat. Off. . |
| 2-274180 | 9/1992 | Japan . |
| 6-310200 | 11/1994 | Japan . |
| 7-52626 | 11/1995 | Japan . |

*Primary Examiner*—Renee Luebke
*Assistant Examiner*—J. F. Duverne
*Attorney, Agent, or Firm*—Finnegan, Henderson, Farabow, Garrett & Dunner, L.L.P.

[57] ABSTRACT

Plural sub-connectors (13), where terminal housing chambers (29) for housing terminals (21) are formed, are inserted into a holding member (12). Double engagement members (31), which have engagement claw (33) sections to be engaged with the terminals (21) externally and abutting sections (34) to abut an inner surface of the holding member (12), are provided on an outer wall of the connector housing (22) of the male sub-connectors (13) so as to prevent the terminals (21) from slipping off.

7 Claims, 5 Drawing Sheets

CONNECTOR HAVING A HOLDER FOR MALE SUB-CONNECTORS

BACKGROUND OF THE INVENTION

1. Field of the Invention

The present invention relates to a connector in which plural male sub-connectors are mounted to a holding member so as to be connected collectively.

2. Description of the Related Art

A conventional connector for assembling plural sub-connectors is disclosed in Japanese Patent Application Laid-Open No. 4-274180.

This connector is constituted so that plural male sub-connectors housing plural terminals are amounted to a first frame so as to be arranged sideways, and female sub-connectors corresponding to the male sub-connectors are mounted to a second frame so as to be arranged sideways. The male sub-connectors and the female sub-connectors are fixed to the first and second frames respectively by bending engagement pieces having hinges provided on the frames. Moreover, slip-off prevention spacers are inserted respectively into the sub-connectors so as to prevent the sub-connectors from slipping out of the frames. In the connector having such a structure, the first and second frames are mounted by screwing a bolt section into a female thread section and caulking the bolt section. As a result, the male and female sub-connectors are fitted into each other.

In addition, a convention connector disclosed in Japanese Patent Application Laid-Open No. 6-310200 is constituted so that plural male sub-connectors are mounted around the center of a first frame, and female sub-connectors are mounted to positions of a second frame which match with the male sub-connectors, and the first and second frames are assembled. As a result, a multipolar connector is obtained.

These connectors can be miniaturized by mounting plural male sub-connectors housing plural terminals even in the case of a multipolar connector. A lance, which is engaged with terminals so as to prevent the terminals from slipping off, is provided to the male sub-connector.

However, since a multipolar (connector disagrees with miniaturization of a connector, in a connector which satisfies both a multipolar structure and miniaturization, strength of the structure is deteriorated. For this reason, a lance which prevents terminals from slipping off is weakened, and an engagement member for fixing sub-connectors to a frame is also weakened. Further, deformation and rise due to the weakening easily occur, and thus a holding force of the terminals is lowered. Therefore, there arises a new problem that the terminals slip off easily.

SUMMARY OF THE INVENTION

It is an object of the present invention to provide a connector in which even if it has a multipolar structure and is miniaturized, terminals can be held securely so as to be prevented from slipping off.

To achieve the above object, there is provided a connector comprising:

male sub-connectors in which terminal housing chambers for housing terminals are formed;

a holding member into which the male sub-connectors are inserted; and a double engagement member having an engagement claw section for engaging the terminals externally and an abutting section abutting against an inner surface of the holding member, the double engagement member provided on an outer wall of the connector housing of the male sub-connectors.

When the engagement claw section engages the terminals, the double engagement member prevents the terminals from slipping off. Moreover, when the abutting section of the double engagement member abuts against the inner surface of the holding member, the engagement claw section is prevented from releasing the engagement with the terminals. Therefore, the holding force or the engagement force of the terminals becomes stronger, and thus even if a tension force is applied to the terminals, the terminals do not slip off.

Preferably, the double engagement member is provided on the outer wall of the connector housing via hinge section so as to be able to rise and lie.

With this configuration, when the double engagement member is revolved about the hinge section toward the connector housing, the engagement claw section of the double engagement member engages the terminals externally. As a result, the engagement with the terminals can be made simply.

Preferably, the hinge section may be positioned in an upper stream side with respect to a direction where the terminals are inserted.

The tension force which draws cut the terminals is applied in an lower stream direction with respect to the terminal insertion direction. In this configuration, the hinge section is positioned on the upper stream side with respect to the terminal insertion direction, and the tension force is applied to the terminals in the lower stream direction. As a result, the abutting section of the double engagement member abuts against the inner surface of the holding member firmly. As a result, the engagement force of the engagement claw section with the terminals becomes stronger, and thus the terminals do not slip off.

Preferably, the connector housing is constituted so that plural terminal housing chambers are formed so as to be arranged sideways, and the double engagement member is provided so as to cross the plural terminal housing chambers arranged sideways.

With this configuration, the double engagement member is provided so as to cross the plural terminal housing chambers arranged sideways, it simultaneously acts on all the terminal housing chambers arranged sideways. For this reason, it simultaneously prevents the terminals housed in the terminal housing chambers arranged sideways from slipping off. Therefore, they can prevent the slipping-off easily.

Preferably, the double engagement member is formed on the upper and lower outer walls of the connector housing.

When the male sub-connectors are inserted into the holding member, the double engagement members formed on the upper and lower outer walls of the connector housing abut against the upper and lower inner surfaces of the connector housing. For this reason, the double engagement members are pushed from both upper and lower directions so as to be engaged with the terminals. As a result, the stable engagement can be obtained.

Preferably, engagement locking means, which is engaged with each other so as to prevent the male sub-connectors from slipping off, is provided in the male sub-connectors and the holding member.

With this configuration, since the engagement locking means prevents the male sub-connectors from slipping off, the male sub-connectors are brought into the slip-off preventing state itself, and stable assembly can be carried out.

Preferably, the engagement locking means comprises a lock protrusion of a flexible engagement arm provided to the male sub-connectors and a lock groove which is provided in the holding member and is engaged with the lock protrusion.

With this configuration, since the lock protrusion is provided to the flexible engagement arm, the lock protrusion can be easily engaged with the lock groove. In this engagement state, the male sub-connectors are prevented from slipping off.

BRIEF DESCRIPTION OF THE DRAWINGS

FIG. 4A is a sectional view showing a first engagement state, and FIG. 4B is a sectional view showing a second engagement state.

DETAILED DESCRIPTION OF THE PREFERRED EMBODIMENT

An embodiment of the present invention will be described with reference to the accompanying drawings.

Figure 1:
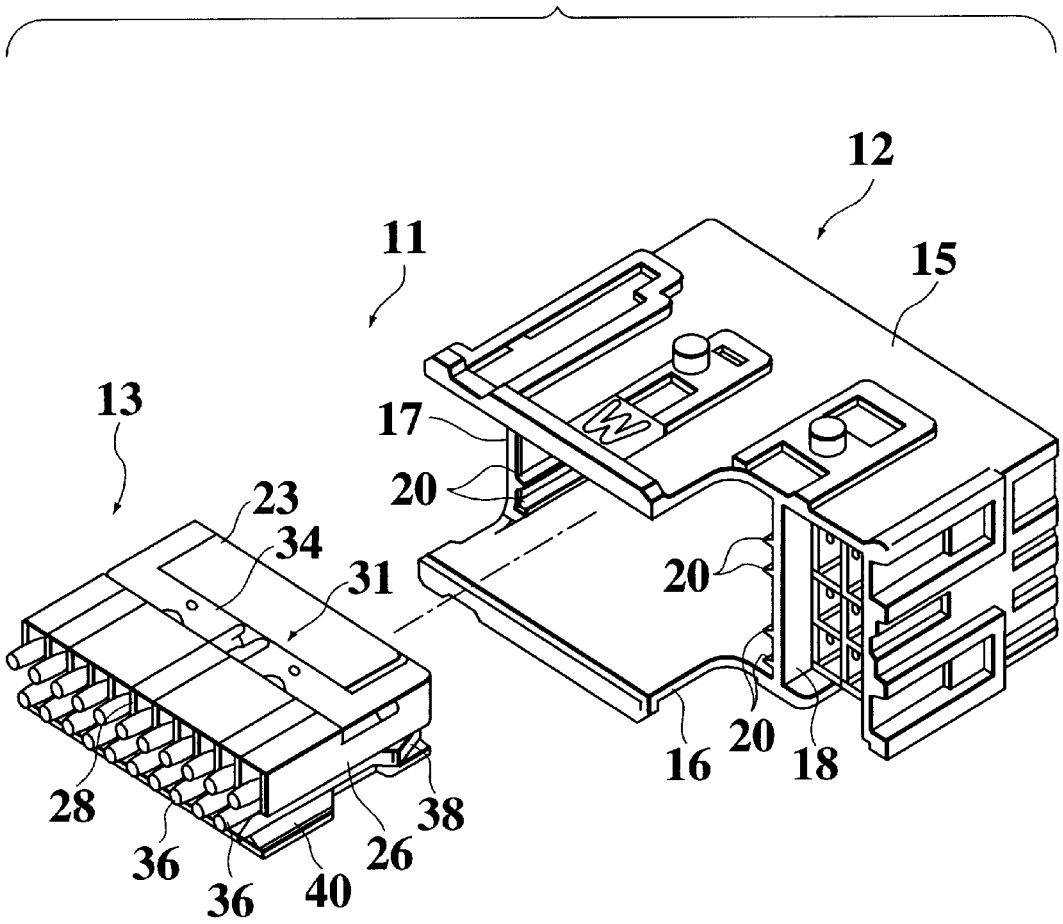
FIG. 1 is a perspective view showing the whole of one embodiment of the present invention.
Figure 2:
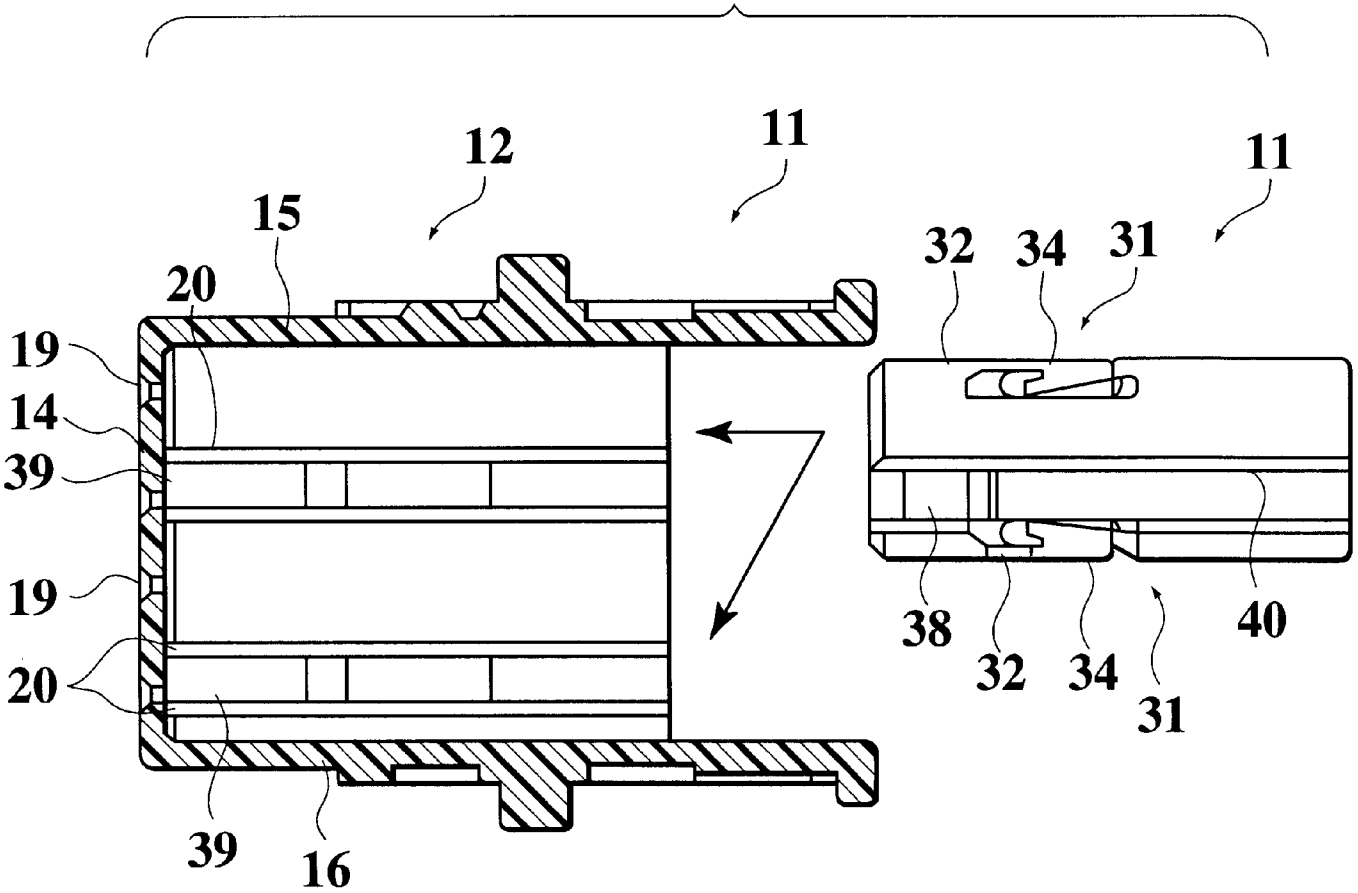
FIG. 2 is a sectional view showing a state that male sub-connectors are inserted into a holding member.

Now referring to FIG. 1, a connector 11 according to the present embodiment has a holding member 12, and plural male sub-connectors 13 mounted into the holding member 12.

The holding member 12 is surrounded by a front wall 14, an upper wall 15, a lower wall 16 and right and left side walls 17 and 18, and is formed into a rectangular box shape where its back portion is opened. Tapered mating terminal insertion openings 19 are opened on the front well 14 so as to be arranged in lines longitudinally and latitudinally, and mating terminals (not shown) of a mating connector are inserted into the mating terminal insertion openings 19. Here, plural terminal housing chambers for housing respective terminals are formed on the outer surface of the right side wall 18.

Horizontal ribs 20 are formed on inner surfaces of the right and left side walls 17 and 18 of the holding member 12 along a direction where the male sub-connectors 13 are inserted. The upper and lower ribs make a pair, and a pair of the ribs 20 locate the male sub-connector 13 in a prescribed position of the holding member 12. In the present embodiment, the male sub-connectors 13 are inserted into the holding member 12 so as to be arranged in upper and lower positions. For this reason, two pairs of the upper and lower ribs 20 are formed on the right and left side walls 17 and 18.

Figure 4A:
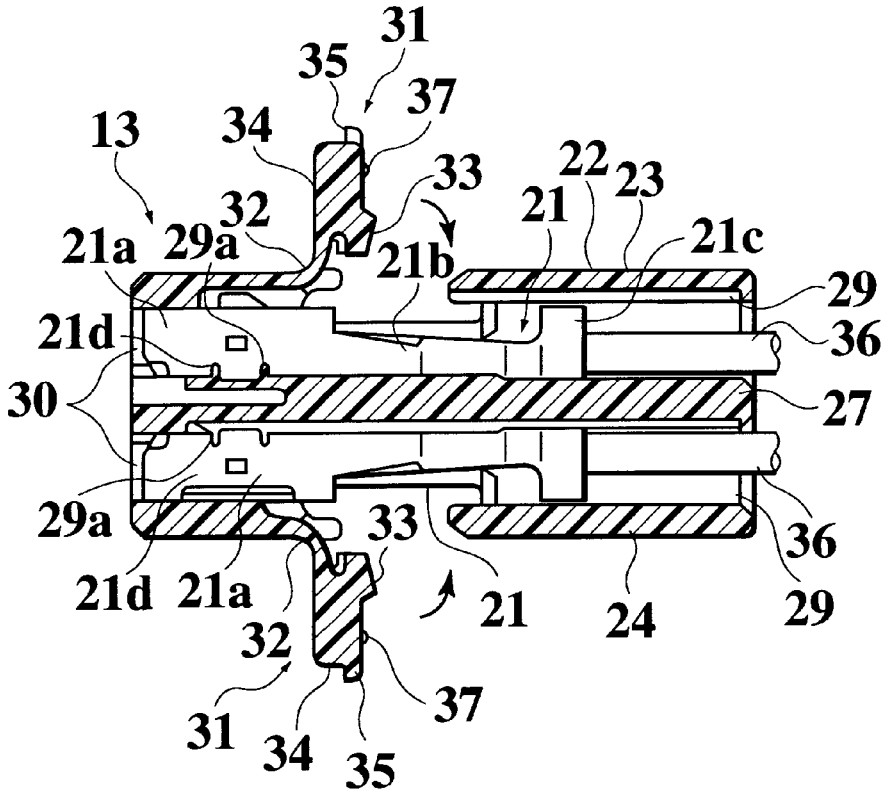
FIGS. 4A and 4B show an operation of a double engagement member.
Figure 4B:
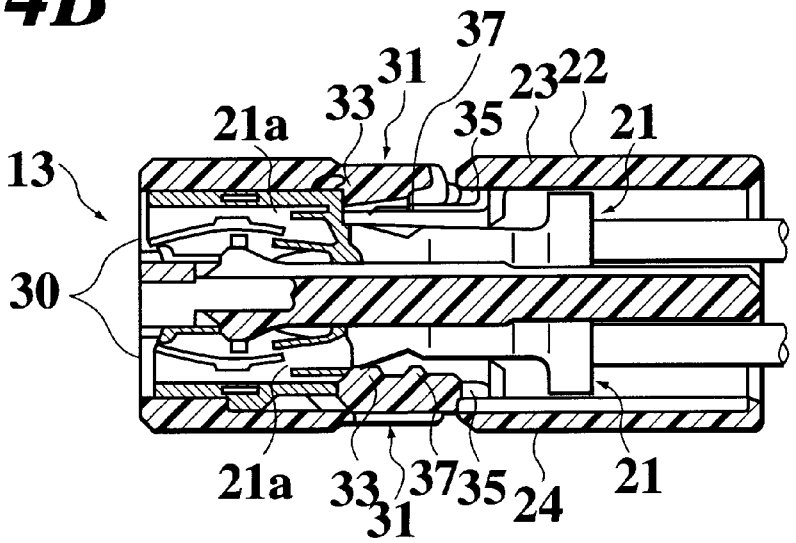

The male sub-connector 13 has a connector housing 22 for housing the plural terminals 21 in the upper and lower positions. The whole shape of the connector housing 22 is rectangular. As shown in FIGS. 4A and 4B, the connector housing 22 has an upper wall 23, a lower wall 24 and right and left side walls 25 and 26, and it has a division wall 27, which separates the terminals 21 in the upper and lower positions, between the upper wall 23 and the lower wall 24.

In addition, plural partition walls 28 are formed between the right and left side walls 25 and 26, and thus portions divided by the partition walls 28, the division wall 27 and the right and left side walls 25 and 26 serve as terminal housing chambers 29. The terminal housing chambers 29 are separated in upper and lower lines, and are respectively arranged sideways. The terminal housing chambers 29 are opened at their back portions, and the terminals 21 are housed respectively in the terminal housing chambers 29 from their opened back portions. Further, mating terminal insertion openings 30 corresponding to the terminal housing chambers 29 are opened at the front portion of the connector housing 22.

In addition, as shown in FIGS. 4A and 4B, engagement sections 29*a* are formed respectively in the terminal housing chambers 29. On the other hand, engagement receiving sections 21*d* which are engaged with the engagement sections 29*a* are formed respectively on the lower surfaces of contact sections 21*a* of the terminals 21. When the engagement sections 29*a* and the engagement receiving sections 21*d* are engaged with each other, the terminals 21 are brought into a first engagement state, and the terminals 21 are prevented from slipping out of the terminal housing chambers 29.

Groove sections 40 are formed on the outer surfaces of the right and left side walls 25 and 26 of the connector housing 22. The groove sections 40 are extended along the direction where the male sub-connectors 13 are inserted into the holding member 12, and a pair of the ribs 20 formed on the inner surface of the holding member 12 come thereinto. As a result, the male sub-connectors 13 are located in prescribed positions of the holding member 12.

Figure 3:
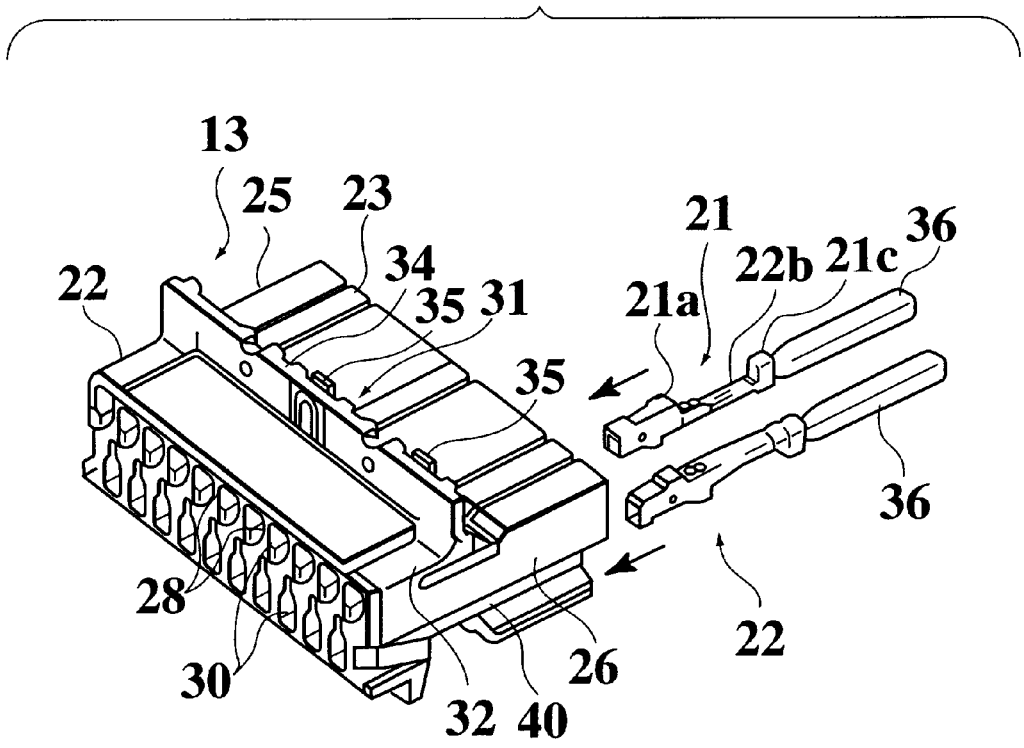
FIG. 3 is a perspective view showing a state that terminals are inserted into the male sub-connectors.

Double engagement members 31 are provided to the male sub-connector 13. As shown in FIGS. 3, 4A and 4B, the double engagement members 31 are formed by partially cutting and rising the upper wall 23 and the lower wall 24 of the connector housing 22. Namely, thin hinge sections 32 are formed on the upper wall 23 and the lower wall 24 of the connector housing 22, and the double engagement members 31 are provided so as to be continuous with the hinge sections 32. As a result, the double engagement members 31 compose a portion of the upper wall 23 and the lower wall 24. When the double engagement members 31 are provided so as to be continuous with the hinge sections 32, they can rise and lie on the upper wall 23 and the lower wall 24. The double engagement members 31 are substantially flush with the upper wall 23 and the lower wall 24 by their revolving to the lying-down direction. As a result, the double engagement members 31 become one portion of the upper wall 23 and the lower wall 24.

The engagement member 31 has an engagement claw sections 33, an abutting section 34 and an engagement convex section 35. The engagement claw sections 33 cone respectively into the terminal housing chambers 29 by revolving the double engagement members 31 to the lying-down direction, and as a result, the double engagement members 31 are engaged with the terminals 21 in the terminal housing chambers 29 externally. This engagement prevents the terminals 21 from slipping off. In the present embodiment, the engagement claw sections 33 are engaged with backward sides of the tubular contact sections 21*a* at the points of the terminals 21 (see FIG. 5).

The abutting sections 34 are composed of surfaces on the side opposite to the surfaces where the engagement claw sections 33 are formed. Namely, the abutting sections 34 are the outer surfaces of the double engagement members 31. When the double engagement members 31 are revolved to the lying-down direction, the abutting sections 34 become a portion of the outer surfaces of the upper wall 23 and the lower wall 24. When the male sub-connectors 13 are inserted into the holding member 12, the abutting sections 34 respectively abut against the inner surfaces of the upper wall 15 and the lower wall 16 of the holding member 12. This abutting prevents the double engagement members 31 from rising from the connector housing 22, and as a result, the engagement claw sections 33 can be engaged with the terminals 21 stably and securely.

The engagement convex sections 35 are formed so as to be projected from the end portions opposite to the hinge sections 32. When the double engagement members 31 are revolved to the lying-down direction, the engagement convex sections 35 are engaged with the upper wall 23 and the lower wall 24 respectively, and this engagement maintains the double engagement members 31 in the lying-down state. Here, pressing convex sections 37 composed of a small projection are formed respectively on the surfaces of the double engagement members 31 on the side of the terminal housing chambers 29 which are close to the engagement convex sections 35. When the pressing convex sections 37 press connection sections 21*b* of the terminals respectively, the terminals 21 are prevented from rising.

The double engagement members 31 are formed so as to have a length equal with the whole width of the upper wall 23 and the lower wall 24. As a result, their width are enough long to cross all the terminal housing chambers 29 which are arranged sideways. Moreover, the engagement claw sections 33 are formed in a band shape so as to be continuous along the lengthwise direction of the double engagement members 31. According to such a structure, when the double engagement members 31 are revolved to the lying-down direction, the engagement claw sections 33 cross all the terminal housing chambers 29 which are arranged sideways. As a result, the engagement claw sections 33 can be engaged with all the terminals 21 housed in the terminal housing chambers 29 simultaneously. For this reason, the engagement with the terminals 21 can be carried out simply. Here, as shown in FIG. 3, the engagement convex sections 35 are formed along the lengthwise direction of the double engagement members 31 at a suitable interval.

Further, in the present embodiment, the hinge sections 32 are positioned on an upper stream side of the terminals 21, namely, on the side of the mating terminal insertion openings 30 with respect to the direction where the terminals 21 are inserted into the terminal housing chambers 29. A tension force is applied to the terminals 21 in a direction opposite to the terminal insertion direction. When the hinge sections 32 are provided in the upper stream side with respect to the terminal insertion direction as mentioned above, the abutting sections 34 of the double engagement members 31 firmly abut against the inner surfaces of the upper wall 15 and the lower wall 16 of the holding member 12 by the tension force applied to the terminals. Therefore, the engagement claw sections 33 are pushed towards the terminals 21, and the engagement force of the engagement claw sections 33 with the terminals 21 becomes strong. As a result, the terminals 21 do not slip off.

In the present embodiment, engagement locking means is provided along the side walls 25 and 26 of the male sub-connector 13. The engagement locking means is composed of a lock protrusion 38 and a lock groove 39 of a flexible engagement arm. The lock protrusion 38 is formed at the edge portions of the outer surfaces of the right and left side walls 25 and 26 of the connector housing 22, and its height is set so as not to be projected from the right and left side walls 25 and 26. The lock groove 39 is formed at the edge portions of the inner surfaces of the right and left side walls 17 and 18 of the holding member 12. When the male sub-connectors 13 are inserted into the holding member 12, the lock protrusions 38 are engaged respectively with the lock grooves 39. This engagement prevents the male sub-connectors 13 from slipping out of the holding member 12.

The following will describe the assembly procedure according to the present embodiment. As shown in FIG. 3, the double engagement member 31 rises from the connector housing 22. Moreover, the terminals 21 are used for the assembly with them being connected with the electric wires 36. This connection is made by caulking the connection sections 21*b* of the terminals 21 to the conductors of the electric wires 36, and simultaneously the caulking sections 21*c* of the terminals 21 are caulked to the insulating coatings of the electric wires 36. As a result, the electric wires 36 are fixed to the terminals 21.

Then, the terminals 21 are inserted respectively into the terminal housing chambers 29 of the male sub-connectors 13. As shown in FIG. 4A, as a result of the insertion, the engagement receiving sections 21*d* on the lower surface of the contact sections 21*a* of the terminals 21 are engaged with the engagement sections 29*a* of the terminal housing chambers 29 so that the terminals 21 are prevented from slipping off, namely, are brought into the first engagement state.

Thereafter, the double engagement members 31 are revolved to the lying-down direction represented by an arrow in FIG. 4A via the hinge sections 32. As a result of the revolving, the engagement convex sections 35 are engaged respectively with the upper wall 23 and the lower wall 24 of the connector housing 22, and as shown in FIG. 4B, the double engagement members 31 are substantially flush with the upper wall 23 and the lower wall 24. Moreover, the engagement claw sections 33 of the double engagement members 31 are engaged with the back sides of the contact sections 21*a* of the terminals 21. As a result, the terminals 21 are engaged with the double engagement members 31, namely, they are brought into the second engagement state also on the aforementioned side opposite to the engagement receiving sections 21d. In the second engagement state, since the terminals 21 are fixed to the terminal housing chambers 29 firmly, even if the tension force is applied to the terminals 21, the terminals 21 do not slip of unexpectedly.

Figure 5:
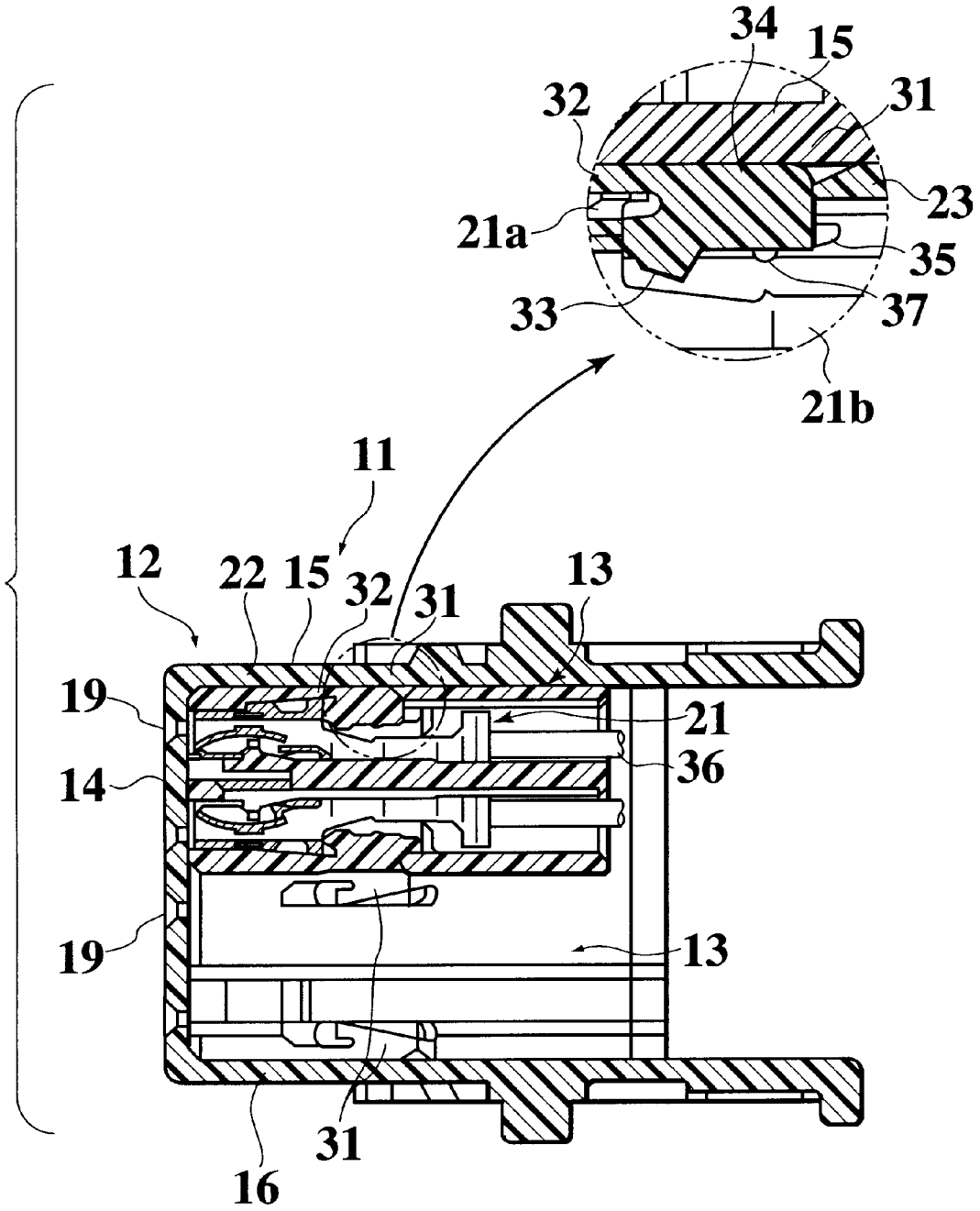
FIG. 5 is a sectional view and an enlarged sectional view showing a function of the double engagement member.

After the above process, the male sub-connectors 13 are inserted into the holding member 12. This insertion is made in such a manner that after the ribs 20 of the holding member 12 are put into the groove sections 40 on the outer surfaces of the male sub-connectors 13, the male sub-connectors 13 are pushed into the holding member by using the ribs 20 as a guide. As a result, the lock protrusions 38 of the male sub-connectors 13 are engaged with the lock grooves 39 of the holding member 12 respectively. For this reason, the male sub-connectors 13 do not slip off and are fixed to the holding member 12. In this fixed state, since the male sub-connectors 13 are located by the ribs 20 and the groove sections 40, as shown in FIG. 5, the mating terminal insertion openings 30 of the male sub-connectors 13 can be interconnected with the mating terminal insertion openings 19 of the holding member 12.

In addition, since the abutting sections 34 of the double engagement members 31 abut against the inner surface of the holding member 12, the double engagement members 31 do not rise. For this reason, the engagement of the engagement claw sections 33 with the terminals 21 is not released, and thus the terminals 21 can be fixed into the terminal housing chambers 29 firmly.

In the connector 11 in such an assembly state, even if the tension force in the drawn-out direction is applied to the terminals 21, the abutting sections 34 of the double engagement members 31 abut against the inner surface of the holding member 12 more firmly, and as a result of the abutting, the engagement claw sections 33 are pushed in the direction of the engagement with the terminals 21. For this reason, the engagement of the engagement claw sections 33 is not released, and thus the terminals 21 do not slip off. Particularly in the present embodiment, since the hinge sections 32 are positioned in the upper stream side with respect to the direction where the terminals 21 are inserted, when the tension force in the lower stream direction is applied, as shown in the enlarged drawing in FIG. 5, the abutting sections 34 in the side lower than the hinge sections 32 are shifted in the rising direction. As a result of the shifting, the abutting sections 34 abut against the inner surface of the holding member 12 firmly. For this reason, the engagement claw sections 33 do not slip out of the terminals 21, and thus the terminals 21 do not lip off.

In addition, in the present embodiment, the double engagement members 31 are formed on the upper wall 23 and the lower wall 24 of the connector housing 22. When the male sub-connectors 13 are inserted into the holding member 12 so as to be arranged in the two positions, as shown in FIG. 5, the double engagement members 31 of the male sub-connectors 13 arranged in the two positions abut against the lower surface of the upper wall 15 of the holding member 12, the outer surface and the lower surface of the mating sub-connector 13 piled on itself, and the upper surface of the lower wall 16 of the holding member 12. For this reason, since the double engagement members 31 of the male sub-connectors 13 are pushed from both upper and lower directions, they do not rise. As a result, the engagement of the engagement claw sections 33 can be stable.

What is claimed is:

1. A connector comprising:

at least one male sub-connector body in which a plurality of terminal housing chambers for housing terminals are formed;

a holding member configured to receive the at least one male sub-connector body; and a double engagement member disposed on an outer wall of said male sub-connector body, said double engagement member having an engagement claw portion for engaging external portions of the terminals in the terminal housing chambers and an abutting portion for abutting against an inner surface of the holding member when the male sub-connector body is received by the holding member.

2. The connector according to claim 1, wherein the double engagement member is connected to the outer wall of the male sub-connector body via hinge sections so as to be able to rise with respect to and lie substantially along the male sub-connector body.

3. The connector according to claim 2, wherein the hinge section is positioned in an upper stream side with respect to a direction where the terminals are inserted.

4. The connector according to claim 1, wherein the plurality of terminal housing chambers are provided so as to be arranged sideways, and the double engagement member is provided so as to cross the plurality of terminal housing chambers arranged sideways.

5. The connector according to claim 1, wherein there are double engagement members formed on each of upper and lower outer walls of the male sub-connector body.

6. The connector according to claim 1, further comprising engagement locking mechanisms provided on each of the male sub-connector body and the holding member respectively, said engagement locking mechanisms configured to engage with each other so as to prevent the male sub-connector body from slipping.

7. The connector according to claim 6, wherein the engagement locking mechanisms comprise a lock protrusion of a flexible engagement arm provided on the male sub-connector body and a lock groove provided in the holding member, said lock protrusion and said lock groove engaging each other.

* * * * *